US005884503A

United States Patent [19]

Inaba

[11] Patent Number: 5,884,503

[45] Date of Patent: Mar. 23, 1999

[54] CONDENSER WITH LIQUID TANK AND MANUFACTURING METHOD THE SAME

[75] Inventor: Hiroyuki Inaba, Tokyo, Japan

[73] Assignee: Calsonic Corporation, Tokyo, Japan

[21] Appl. No.: 949,390

[22] Filed: Oct. 14, 1997

[30] Foreign Application Priority Data

Oct. 14, 1996 [JP] Japan ..... 8-270762

[51] Int. Cl.[6] ..... F29B 39/04

[52] U.S. Cl. ..... 62/509; 62/507

[58] Field of Search ..... 62/509, 512, 507; 165/110

[56] References Cited

U.S. PATENT DOCUMENTS

| | | | |
|---|---|---|---|
| 5,159,821 | 11/1992 | Nakamura | 165/110 |
| 5,505,253 | 4/1996 | Heraud | 165/110 |
| 5,546,761 | 8/1996 | Matsuo et al. | 62/509 |
| 5,628,206 | 5/1997 | Baba | 62/507 |
| 5,709,106 | 1/1998 | Inaba et al. | 62/507 |

*Primary Examiner*—William Doerrler
*Attorney, Agent, or Firm*—Sughrue, Mion, Zinn, Macpeak & Seas, PLLC

[57] ABSTRACT

A casing forming a liquid tank is welded through coupling brackets to a first header pipe forming a condenser by brazing. This coupling brackets are smaller in thermal capacity than the casing and the first header pipe.

5 Claims, 7 Drawing Sheets

CONDENSER WITH LIQUID TANK AND MANUFACTURING METHOD THE SAME

BACKGROUND OF THE INVENTION

1. Field of the Invention

A condenser with a liquid tank according to the invention is set between the compressor and the evaporator of a steam compression type refrigerator forming an automobile air conditioner. After the coolant compressed by the compressor is cooled and condensed, foreign matter such as water content are removed from the coolant. And the refrigerant thus treated is supplied to the evaporator.

2. Description of the Prior Art

A vehicle air conditioner adapted to cool and dehumidify the inside of a motor vehicle includes a steam compression type refrigerator. FIG. 8 is a circuit diagram showing the fundamental arrangement of a steam compression type refrigerator which has been disclosed in Japanese Patent Publication No. Hei. 4-95522. The gas-phase coolant (high temperature and high pressure) discharged from a compressor 1 heat-exchanges with air while passing through a condenser, thus being cooled and condensed; i.e, liquified. The resultant liquid-state coolant is stored in a liquid tank, and then supplied through an expansion valve 4 to an evaporator 5, where it is evaporated. The temperature of the evaporator 5 is decreased because the evaporation latent heat is taken. Hence, when air-conditioning air is caused to flow in the evaporator 5, this air is decreased in temperature, while the steam contained in said air can be removed. The coolant which has been evaporated and gasified is sucked into the compressor 1, where it is compressed. The above-described operations are cyclically carried out.

The liquid tank 3 forming the steam compression type refrigerator of a vehicle air condition is formed as an unit separate from the condenser 2, and it is connected to a pipe which is connected between the condenser 2 and the evaporator 5. In the case where, as was described above, the liquid tank 3 is a unit separate from the condenser 2, the space of installation thereof is increased as much as that for the liquid tank 3. In addition, it is necessary to secure the liquid tank 3 to the vehicle body in such a manner that it is sufficiently durable against vibration independently of the condenser 2. Furthermore, the manufacture, part control, and assembling work of the pipes connected between the condenser 2 and the liquid tank are required, which increases the cost of the vehicle air condition.

In order to overcome the above-described difficulties, and to solve the problem of manufacturing cost, a structure in which the liquid tank 3 and the condenser 2 are provided as one unit, has been proposed by Japanese Patent Publication Nos. Hei. 3-87572, 4-103973, and 4-131667. FIG. 9 shows the structure disclosed by Japanese Patent Publication No. Hei. 4-103973. The condenser 2 has a pair of header pipes 6*a* and 6*b* which are horizontally spaced from each other and are extended vertically (in FIG. 9). Between those header pipes 6*a* and 6*b*, a plurality of flat heat-transmitting pipes 7, 7, 7, . . . are provided. Those heat-transmitting pipes 7 are vertically spaced from one another, and extended horizontally. Each of the heat-transmitting pipes 7 is inserted into the pair of header pipes 6*a* and 6*b* gas-tight and liquid-tight, in such a manner that its inside is communicated with the insides of the header pipes 6*a* and 6*b*. Between adjacent flat heat-transmitting pipes 7, a corrugated fin 8 formed by bending a thin metal sheet zig-zag is held, thus forming a core section. Side plates 10 and 11 are provided on the upper and lower sides of the core section 9 thus formed, respectively. Both ends of each of the side plates 10 and 11 are fixedly coupled to the insides of the upper and lower portions of the header pipes 6*a* and 6*b*. Those members forming the condenser 2 are made of aluminum alloy.

The condenser 2 thus formed functions as follows: In the aforementioned core section 9, heat-exchange is carried out between the coolant flowing in the flat heat transmitting pipes 7 and the air flowing in the flat heat transmitting pipes 7, so that the coolant is condensed and liquified. That is, the gas-phase coolant supplied through an inlet pipe 12 which is connected to the upper end portion of the first header pipe 6*a* (on the right side of FIG. 9), while moving between the header pipe 6*a* and the second header pipe 6*b* (on the left side of FIG. 9) back and forth, flows in the flat heat-transmitting pipes 7 forming the core section 9, thus being condensed and liquified. The resultant liquid-phase coolant is pooled in the lower end portion of the header pipe 6*a*, thus being sent through a coolant sending pipe 13 to the liquid tank 3.

On the other hand, the liquid tank 3 is secured to the outside surface of the first header pipe 6*a*. That is, a cylindrical casing body 14 of aluminum alloy, which forms the liquid tank 3, is fixedly secured to the side surface of the header pipe 6*a* by blazing or the like. The lower end opening of the casing body 14 is closed with bottom plate 15, and the upper end opening of the casing body 14 is closed with a top plate 16. The aforementioned coolant sending pipe 13 penetrates the bottom plate 15, and is extended along the central axis of the casing body 14, so that a cylindrical space 18 is formed between the outer cylindrical surface of the coolant sending pipe 3 and the inner cylindrical surface of the casing body 14. The upper half of the coolant sending pipe 13 in the casing body 14 has a number of small holes, 17, 17, 17, . . . , to freely discharge the liquid-phase coolant which has been sent into the coolant sending pipe 13 from the header pipe 6*a*. In the middle portion of the space 18, a filter 19 made of porous material such as felt is set, and a drying agent 20 such as silica gel and calcium chloride is laid on the filter 19, and a porous retaining plate 21 made of a metal net or punching metal plate is laid on the drying agent 20. The filter 19 and the drying agent 20 form a means for removing foreign matter from the coolant. The lower end portion of the casing body 14 is connected to an outlet pipe 22 to freely take the coolant out of the lower end portion of the aforementioned space 18.

In the use of the condenser with the liquid tank (in the operation of the steam compression type refrigerator having the condenser with the liquid tank), the coolant flowing as indicated by the arrows in FIG. 9, after being condensed and liquified in the condenser 2, is sent into the liquid tank 3. In the liquid tank 3, moisture, foreign matter, etc. are removed from the coolant; that is, the purified coolant is supplied through the outlet pipe 22 towards the expansion valve 4 (cf. FIG. 8) located immediately before the evaporator 5. As was described above, the condenser and the liquid tank are formed into one unit; that is, they can be handled as one unit. Hence, they can be readily installed in a limited space in the engine room. In addition, it is unnecessary to set the condenser 2 and the liquid tank 3 separately for anti-vibration. That is, the installation of the condenser 2 and the liquid tank 3 can be achieved with ease, and it is unnecessary to provide a pipe which connects the condenser 2 to the liquid tank 3. This means that the manufacturing cost is decreased as much.

The conventional condenser with the liquid tank which is designed as described above; however, suffers from the following difficulties: In general, in assembling the liquid tank and the condenser, the first header pipe 6*a* is connected to the liquid tank 3 by brazing. However, the brazing of those members 6*a* and 3 (especially 3) are rather difficult, because they are each in the form of a cylinder which is large in thermal capacity. That is, the members 6*a* and 3 are combined with other members forming the condenser 2 (such as the second header pipe 6*b*, the heat transmitting pipes 7, the fins 8, and side plates 10 and 11) and fixed with a jig (not shown), and then the resultant assembly is set in a heating furnace. In the heating furnace, the assembly is heated at a temperature (for instance 600° C.) which is higher than the melting point of the brazing material applied to at least one of two members (which are to be connected to each other) and is lower than the melting point of the base material (the aluminum alloy which is the core material of each member to maintain its mechanical strength high enough). In those members, the brazing material on each member is molten, so as to be connected to the mating member. In the above-described members, the first header pipe 6*a* and the liquid tank 3 are both large in thermal capacity, and therefore the brazing of those members 6*a* and 3 are rather difficult. That is, the members 6*a* and 3 are increased in temperature slowly when compared with the other members; that is, the melting of the brazing material on at least one of the two members 6*a* and 3 takes time, so that the resultant brazing of the two members 6*a* and 3 is liable to be unsatisfactory. In addition, the time required for those members 6*a* and 3 to be connected to each other by brazing is unavoidably long; that is, the assembling work of the liquid tank and the condenser (including the brazing work) is low in work efficiency. Since the members 3 and 6*a* are cylindrical, the contact surface of them is linear, so that the brazing area is small, and the coupling force is not great enough. As was described above, in the case of the conventional structure, the brazing of the first header pipe 6*a* and the liquid tank 3 is not achieved satisfactorily, the assembling of them is low in work efficiency, and the coupling force of them is also inadequate. In the above-described case, the first header pipe 6*a* is connected to the liquid tank 3 by brazing; however, they may be connected to each other with metal members or the like. However, this method is rather troublesome. In order to increase the coupling force of the liquid tank 3 and the header pipe 6*a*, those members 3 and 6*a* may be so modified that they are flat in section, thereby to increase the coupling area of them. However, the method is undesirable, because the modification lowers the pressure withstanding characteristic.

SUMMARY OF THE INVENTION

In view of the foregoing, a novel condenser with a liquid tank has been provided according to the invention.

There is provided a condenser with a liquid tank comprising: (1) a condenser including: a pair of first and second header pipes which are made of aluminum alloy and arranged spaced from each other; a plurality of heat-transmitting pipes of which both ends thereof are opened inside the first and second header pipes respectively; and fins provided between the heat-transmitting pipes; and (2) a liquid tank including a casing of aluminum alloy which is arranged along the first header pipe; and (3) a coupling bracket which is smaller in thermal capacity than the casing and the first header pipe, one end of the coupling bracket being secured to an outer cylindrical surface of the casing by brazing, and the other end thereof being secured to an outer cylindrical surface of the first header pipe.

In the condenser with the liquid tank according to the invention, the casing forming the liquid tank is welded to the first header pipe forming the condenser through the coupling brackets by brazing which are smaller in thermal capacity than the casing and the first header pipe, which improves the brazing characteristic, assembling work efficiency, and coupling characteristic of the liquid tank and the condenser. That is, since the coupling brackets are smaller in thermal capacity, the coupling brackets are increased faster in temperature than the casing and the first header pipe. Hence, the parts of the casing and of the first header pipe which are in contact with the coupling brackets are quickly increased in temperature, so that the brazing material on the surfaces of the casing and the first header pipe is quickly molten; that is, the casing is quickly welded to the first header pipe through the coupling brackets by brazing. This means that the brazing characteristic and assembling work efficiency of the condenser with the liquid tank, are improved. In addition, the areas of the junctions of the coupling brackets, and the liquid tank and the condenser are large enough; that is, the brazing area of the liquid tank and the condenser is large enough. Thus, the coupling force of those two members is high.

DETAILED DESCRIPTION OF THE PREFERRED EMBODIMENTS

1st Embodiment

Figure 1:
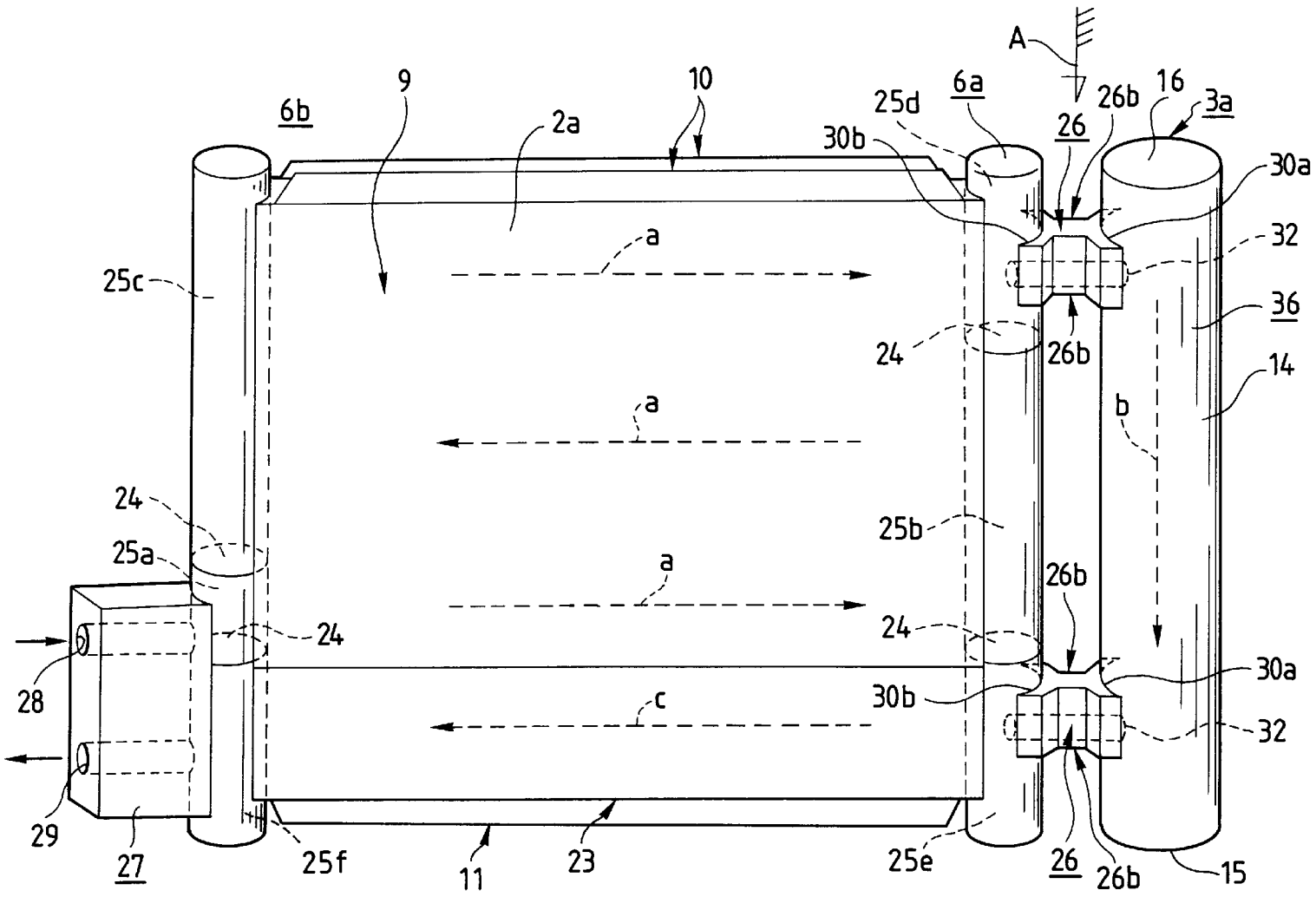
FIG. 1 is a perspective view outlining a first embodiment of the invention.
Figure 2:
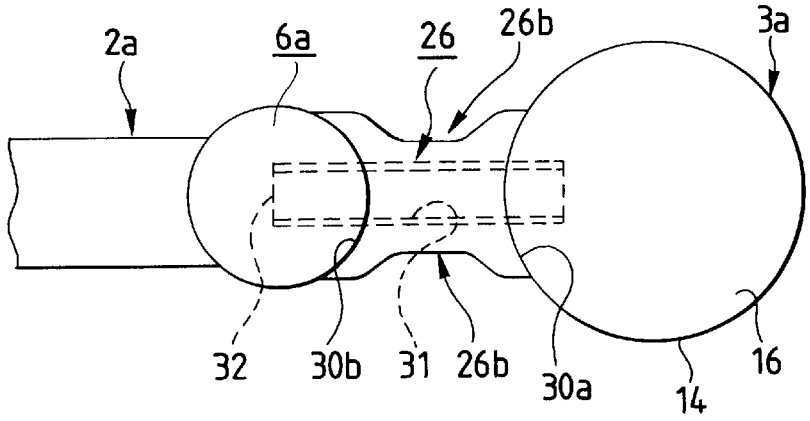
FIG. 2 is a view taken in the direction of the arrow A in FIG. 1.
Figure 3:
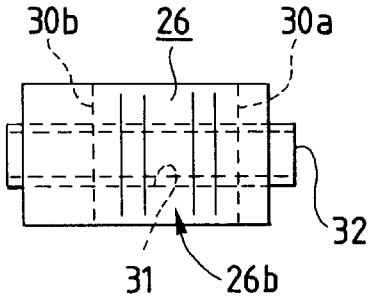
FIG. 3 is a front view showing a coupling bracket forming a structure shown in FIG. 1.
Figure 4:
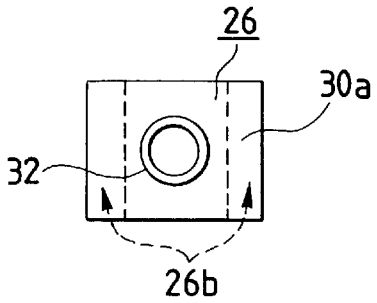
FIG. 4 is a side view showing a coupling bracket forming a structure shown in FIG. 1.

FIGS. 1 through 4 show a first embodiment of the invention. In the first embodiment, the technical concept of the invention is applied to a structure with a sub-condenser which is so designed that the coolant condensed and liquified by a condenser is over-cooled with the sub-condenser and then sent out. That is, in the first embodiment, the condenser with the liquid tank is designed as follows: That is, as shown in FIG. 1, a condenser 2*a*, a liquid tank 3*a*, and a sub-condenser 23 are arranged in series from the upstream side to the downstream side with respect to the directions of flow of coolant as indicated by the arrows a, b and c. The sub-condenser 23 is provided under the condenser 2*a*, and the liquid tank 3*a* is provided beside the condenser 2*a* and the sub-condenser 23.

The condenser 2*a* and the sub-condenser 23 includes a pair of right and left header pipes 6*a* and 6*b* which are arranged spaced from each other. Each of the headers pipes

6*a* and 6*b* is formed by closing the top and bottom openings of a cylindrical-pipe-shaped member, or combining a pair of half-cylindrical portions with half-circular plates at both end portions thereof. Between those header pipes 6*a* and 6*b*, a core section 9 is provided which comprises heat-transmitting pipes 7, 7, 7, . . . and fins 8, 8, 8, . . . similarly as in above-described case. Both ends (right and left ends in FIG. 1) of each of the heat-transmitting pipes 7 penetrate the inner walls (confronted with each other) of the header pipes 6*a* and 6*b* gas-tight and liquid-tight, respectively. The fins 8 are of corrugated type, and the spaces between the heat transmitting pipes 7 are filled with the fins 8. Side plates 10 and 11 are provided on the upper and lower sides of the core section 9, and both ends of each of the side plates 10 and 11 are fixedly coupled to the inner side walls of the upper and lower end portions of the header pipes 6*a* and 6*b* (hereinafter referred to as "first and second header pipes 6*a* and 6*b*", when applicable), respectively. The members forming the condenser 2*a* are of aluminum alloy.

In the embodiment, the lower portion of the core section 9 is employed as the sub-condenser 23. That is, the header pipes 6*a* and 6*b* are partitioned gas-tight and liquid-tight into a plurality of chambers 25*a* through 25*f* with a plurality of partition walls 24, 24, 24, . . . . Of those chambers 25*a* through 25*f*, the lowest chambers 25*e* and 25*f* of the header pipes 6*a* and 6*b* form the aforementioned sub-condenser, and the remaining chambers 25*a* through 25*d* form the aforementioned condenser 2*a*. The coolant supplied into the condenser 2*a* flows back and forth between the pair of header pipes 6*a* and 6*b*.

In the case of the embodiment, a liquid tank 3*a* is arranged beside the header pipe 6*a*. The liquid tank 3*a* is welded to the header pipe 6*a* through coupling brackets 26 and 26 (described later) by brazing. A connecting bracket 27 is welded to the outer surface of the lower end portion of the other header pipe 6*b* by brazing. More specifically, the connecting bracket 27 is arranged on the outer side of the lower end portion of the header pipe 6*b* in such a manner that it is laid over the portion of the condenser 2*a* and the portion of the sub-condenser 23. The connecting bracket 27 has an inlet hole 28 and an outlet hole 25 respectively in the upper portion and the lower portion which are through-holes. More specifically, the inner end opening (the right end opening in FIG. 1) of the inlet hole 28 is communicated with the chamber 25*a* forming the condenser 2*a*, and the inner end opening of the outlet hole 29 is communicated with the chamber 25*f* forming the sub-condenser 23. The outer end opening (the left end opening in FIG. 1) of the inlet hole 28 is connected to a downstream end of a coolant pipe (not shown) adapted to supply coolant, and the outer end opening of the outlet hole 29 is connected to an upstream end of a coolant pipe (not shown) adapted to send out the coolant which has been cooled.

The aforementioned sub-condenser 23 comprises the chambers 25*e* and 25*f* of the header pipes 6*a* and 6*b*, sub-heat-transmitting pipes (not shown) set between the inner sides of the header pipes 6*a* and 6*b* which form the chambers 25*e* and 25*f*, and corrugated fins (not shown) set between them. Both ends (the right and left ends in FIG. 1) of each of the sub heat-transmitting pipes penetrate the inner side walls of the header pipes 6*a* and 6*b* gas-tight and liquid tight. Those sub-heat-transmitting pipes are arranged in parallel with one another, and are spaced from one another. Between adjacent sub-heat-transmitting pipes, the aforementioned fin is held. The same fin is provided between the upper surface of the uppermost sub-heat-transmitting pipe and the lowermost of the several heat-transmitting pipes 7, 7, 7, . . . (cf. FIG. 8), and is held between the lower surface of the lowermost sub-heat-transmitting pipe, and the upper surface of the side plate 11 (cf. FIG. 8) laid between the inner sides of the lower end portions of pair of header pipes 6*a* and 6*b*.

Figure 8:
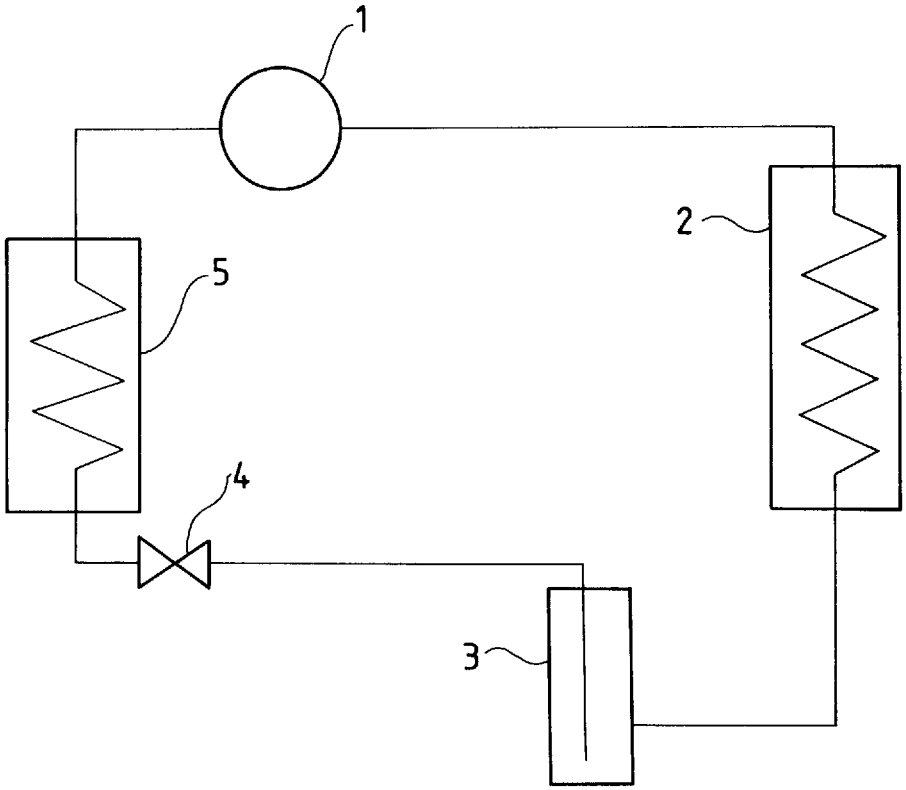
FIG. 8 PRIOR ART
FIG. 8 is a circuit diagram of a steam compression type refrigerator in which a condenser and a liquid tank are built.
Figure 9:
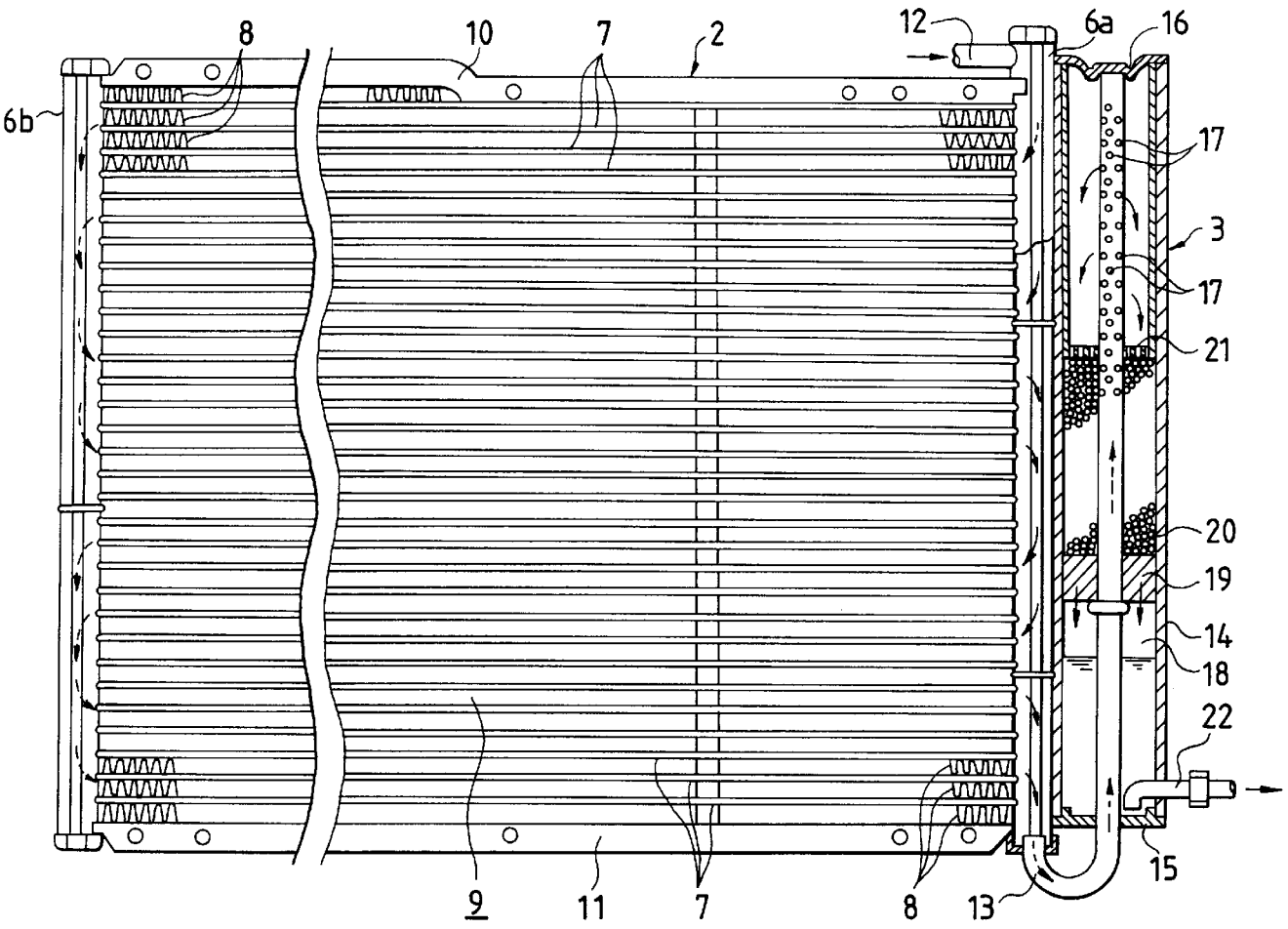
FIG. 9 PRIOR ART
FIG. 9 is a front view, with parts cut away, showing an example of a conventional art concerning the invention.

The structure of the liquid tank 3*a* is similar to the conventional one which has been shown in FIG. 8. That is, it has a casing 36 which is formed by closing the upper end opening of a casing 14 of aluminum alloy with an upper board 16, and by closing the lower end opening with a lower board. Inside the casing body 14, a filter 19 for removing foreign matter such as dust is fitted which is made of porous material such as felt, and a drying agent such as silica gel and calcium chloride is laid over the filter 19, and then a porous retaining board 21 such as a metal net and a punched metal is set on the drying agent 20 (cf. FIG. 8). In the embodiment of the invention, it should be noted that the coolant inlet is provided on the upper portion of the liquid tank, and therefore, unlike the structure shown in FIG. 8, it is unnecessary to provide the coolant sending pipe 13.

In the condenser with the liquid tank, the above-described casing 36 forming the liquid tank 3*a* is connected to the header pipe 6*a* through coupling brackets 26 and 26 of aluminum alloy by brazing. Each of the coupling brackets 26 are made of aluminum alloy, and its configuration and size are so determined that it is smaller in thermal capacity than the casing 36 and the header pipe 61*a*. That is, by die-cast-molding, forging, extrusion molding or grinding aluminum alloy, a block is formed which is rectangular (or circular) in the cross section, and is substantially in the form of a concave lens in a plan view. One end face of each of the blocks (the right side surface in FIGS. 1 through 3) is a connecting recess 30*a* which is brought into close contact with a part of the outer cylindrical surface of the casing body 14 of the liquid tank 3*a*; and the other end face of the block is also a connecting recess 30*b* which is brought into close contact with a part of the outer cylindrical surface of the header pipe 6*a*. Each of the coupling brackets 26 has a small hole 31 which is extended from the one end face to the other end face. A coolant passageway pipe 32 is fixedly inserted into the small hole 31 in such a manner that its both ends are protruded from the two end faces.

In the embodiment, as shown in FIG. 1, the two coupling brackets 26 and 26 are arranged vertically. More specifically, the upper coupling bracket 26 is arranged beside the uppermost chamber 25*d* of the header pipe 6*a*; and the lower coupling bracket 26 is arranged beside the lowermost chamber 25*e* of the header pipe 6*a*. Both end portions of the coolant passageway pipe 32 of each of the coupling brackets 26 and 26 penetrate the walls of the header pipe 6*a* and the casing body 14 gas-tight and liquid-tight which forms the liquid tank 3*a*.

Figure 7:
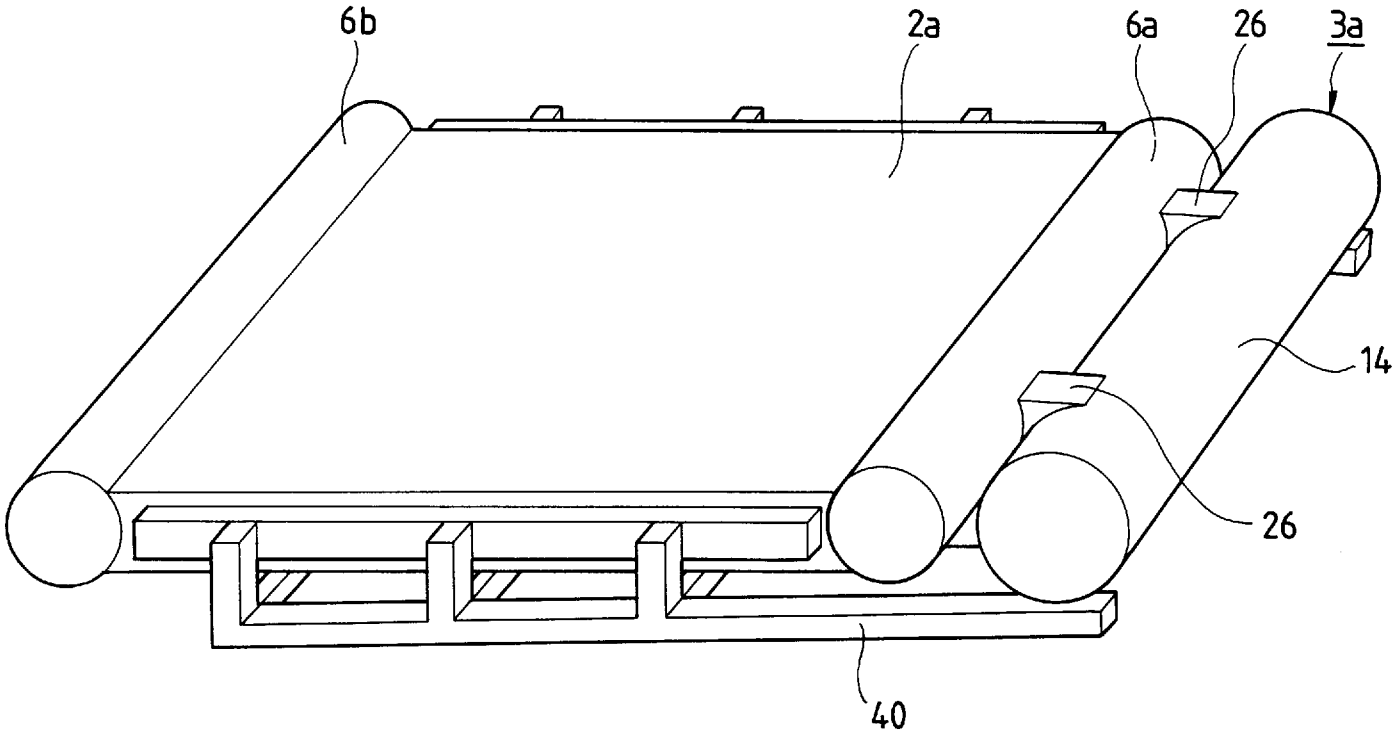
FIG. 7 is a perspective view showing a state in which the condenser with a liquid tank according to the present invention is assembled.

The condenser with the liquid tank is assembled as follows: As shown in FIG. 7, the condenser 2*a* (sub-condenser 23) forming members, the connecting brackets 27, the coupling brackets 26 and 26, and the liquid tank 3*a* are held with the jigs 40, and then heated in the heating furnace, so that they are coupled to one another by brazing all at once. Of course, it is possible to use wires so as to temporarily assemble the coupling bracket, the liquid tank and the header pipe before heating instead of jigs 40. In the case of the condenser with the liquid tank, the coupling brackets 26 and 26 of aluminum alloy are smaller in thermal capacity than the casing body 14 and the header pipe 6*a*, and therefore they are increased quickly in temperature. Hence, the core members of the contact portions of the casing 36 and the header pipe 6*a* which are brought into contact with the connecting recesses 30*a* and 30*b* of the coupling brackets 26 and 26 are also increased quickly in temperature. That is, the joining portions of the members 6*a* and 3*a* which are brought into contact with the connecting recesses 30*a* and 30*b* of the coupling brackets 26 and 26 are quickly increased in temperature. Therefore, of the brazing material applied to the surfaces of the casing 36 and the header pipe 6*a*, the parts which are in contact with the coupling brackets 26 and 26 are positively molten. As a result of the melting of the brazing material, the casing 36 is fixedly coupled through the coupling brackets 26 and 26 to the header pipe 6*a*. That is, the condenser with the liquid tank is improved in brazing characteristic and assembling work efficiency. In addition, the coupling brackets 26 and 26 and the liquid tank 3*a* and the condenser 2*a* are sufficiently large in joining area, and accordingly, the liquid tank 3*a* is sufficiently coupled to the condenser 2*a*.

The above-described condenser with the liquid tank according to the invention is built in a steam compression type refrigerator as follows: The inlet hole 28 of the aforementioned connecting bracket 27 is connected to the downstream end of the coolant pipe which is communicated with the discharging outlet of the compressor; and the outlet hole 29 is connected to the upstream end of the coolant pipe which is communicated with the evaporator. When, under this condition, the compressor is operated, the condenser with the liquid tank according to the invention condenses the coolant supplied from the compressor, and over-cools it, and sends it to the evaporator.

That is, the coolant gas sent into the chamber 25*a* of the condenser 2*a* through the inlet hole 28 of the connecting bracket 27 flows back and forth between the pair of header pipes 6*a* and 6*b* through a plurality of heat transmitting pipes 7, 7, 7, . . . as indicated by the arrows a, a, a, . . . , thus being supplied into the chamber 25*d* of the condenser 2*a*. During this period, the coolant gas heat-exchanges with the air flowing between the heat-transmitting pipes 7 and the fins 8, thus being condensed and liquified. The resultant liquid-state coolant is sent through the coolant passageway pipe 32 of the upper coupling bracket 26 into the upper portion of the liquid tank 3*a*. The liquid-state coolant thus sent flows downwardly in the liquid tank 3*a* as indicated by the arrow b. While the coolant flowing down in the above-described manner, foreign matter and moisture (water content) are removed the coolant by means of the filter 19 and the drying agent 20 which form the foreign matter removing means. The coolant thus treated is supplied through the coolant passageway pipe 32 of the lower coupling bracket 26 into the sub-condenser 23. The coolant thus supplied is cooled while flowing through the sub-heat-transmitting pipes (forming the sub-condenser 23) as indicated by the arrow c. The coolant thus over-cooled is sent through the outlet hole 29 of the connecting bracket 27 into the aforementioned evaporator.

The above-described function is the same as that of the conventional condenser with the liquid tank and the sub condenser. In addition, the feature that the liquid tank 3*a* and the condenser 2*a* are formed into one unit whereby the installation work can be achieved with ease is also the same as that of the conventional condenser with the liquid tank. Particularly, in the case of the condenser with the liquid tank according to the invention, the coupling brackets 26 and 26 are employed. This makes it possible to weld the header pipe 6*a* to the casing 36 forming the liquid tank 3*a* by brazing with ease.

In order to decrease the thermal capacity of the coupling brackets 26 and 26, it is desirable to reduce the volume of each of the coupling brackets 26 and 26 as much as possible. However, in practice, the volume of each of the coupling brackets 26 and 26 is determined according to the balance between the cost and the mechanical strength of supporting the liquid tank 3*a* and the condenser 2*a*. On the other hand, as long as the mechanical strength of supporting the liquid tank and the condenser, it may be possible to make recesses 26*b* in the coupling brackets 26 and 26 to reduce the volume of those coupling brackets 26 and 26 and to increase the surface areas of the latter 26 and 26. It goes without saying that the recesses thus formed are separate from the small holes 31. Of course, it is not essential to provide the recesses 26*b*.

2nd Embodiment

Figure 5:
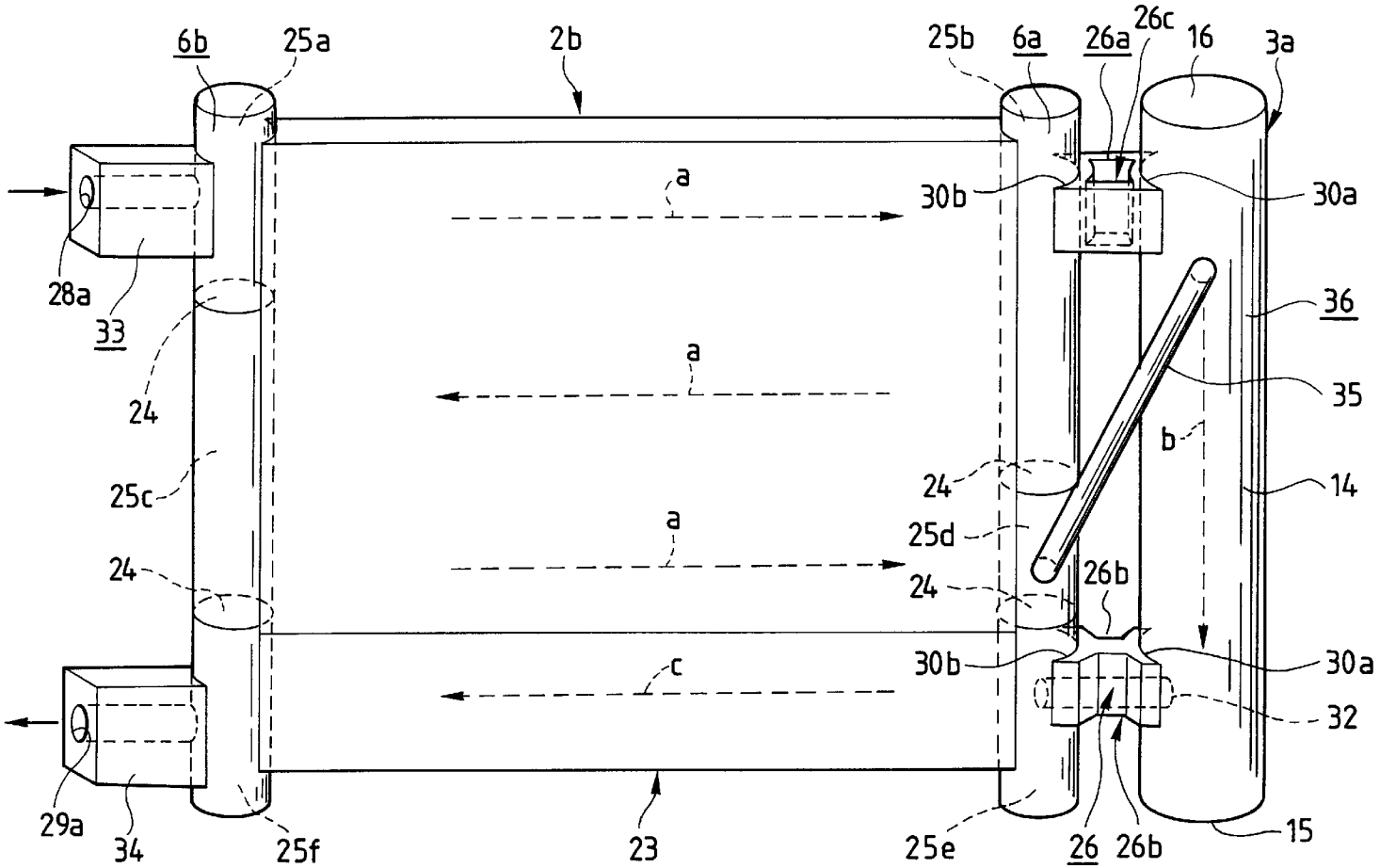
FIG. 5 is a perspective view outlining a second embodiment of the invention.

FIG. 5 shows a second embodiment of the invention. In the second embodiment, the technical concept of the invention is applied to a structure in which coolant flows downwardly in a condenser 2*b*. Similarly as in the case of the first embodiment, a plurality of partition walls 24, 24, 24, . . . are provided in each of header pipers 6*a* and 6*b* forming the condenser 2*b*, to divide the insides of the header pipes 6*a* and 6*b* into a plurality of chambers 25*a* through 25*f* which are held gas-tight and liquid-tight. Of those chambers 25*a* through 25*f*, the lowest chambers 25*e* and 25*f* of the first and second header pipes 6*a* and 6*b* form a sub-condenser 23. The remaining chambers 25*a* through 25*d* form the condenser 2*b*. The coolant supplied into the condenser 2*b* flows back and forth between the header pipes 6*a* and 6*b*.

In the second embodiment, an inlet block 33 is secured to the part of the header pipe 6*b* which corresponds to the uppermost chamber 25*a*, and the inner end opening of the inlet hole 28a of the inlet block 33 is communicated with the interior of the chamber 25*a*. Hence, the coolant gas supplied through the inlet hole 28*a* into the condenser 2*b* flows downwardly in the condenser 2*b*. More specifically, as indicated by the arrows a, a, a, . . . , the coolant gas flows back and forth in heat-transmitting pipes 7, 7, 7, . . . (forming the condenser 2*a* ) between the pair of header pipes 6*a* and 6*b* (cf. FIG. 8). During this period, the coolant gas heat-exchanges with the air flowing the spaces between the heat-transmitting pipes 7 and fins 8; that is, it is condensed and liquified, thus being sent into the chamber 25*d* of the header pipe 6*a*. The chamber 25*d* is communicated through a coolant pipe 35 with the upper portion of a liquid tank 3*a* arranged beside the header pipe 6. The coolant pipe 35 is a hollow pipe of aluminum alloy. Both end portions of the coolant pipe 35 are bent 90° in the same direction. The two end portions thus bent are connected gas-tight and liquid-tight to the chamber 25*d* and the upper portion of the liquid tank 3*a*. The liquid-phase coolant which is sent from the chamber 25*d* through the coolant pipe 35 into the upper part of the liquid tank 3*a* flows downwardly in the liquid tank 3*a* as indicated by the arrow b, so that it is sent into the sub-condenser 23 through the coolant passageway pipe 32 of the lower coupling bracket 26. The liquid-phase coolant which has been sent into the sub-condenser in the above-described manner is over-cooled while flowing through the sub-heat-transmitting pipes as indicated by the arrow c which form the sub-condensers. The coolant thus over-cooled is supplied into the aforementioned chamber 25*f*, and then sent towards the evaporator through the outlet block 34 the inner end opening of the outlet hole 29*a* of which is communicated with the chamber 25*f*.

In the second embodiment, it is unnecessary to provide the coolant passageway pipe 32 (cf. FIGS. 1 through 4) for the upper coupling bracket 26*a* which fixedly hold the header pipe 6*a* and the upper portion of the liquid tank 3*a*.

That is, the coupling bracket is lower in manufacturing cost than the coupling bracket 26 in the first embodiment. In addition, by forming vertical through-holes 26*c* in the coupling bracket 26*a* as shown in FIG. 5, the latter 26*a* can be reduced in volume and increased in surface area. Of course, it is not essential to provide the vertical through-holes 26*c*. The other arrangements of the second embodiment are equal to those of the first embodiment. Hence, in FIG. 5, parts corresponding functionally to those already described with reference to the first embodiment are therefore designated by the same reference numerals or characters.

3rd Embodiment

Figure 6:
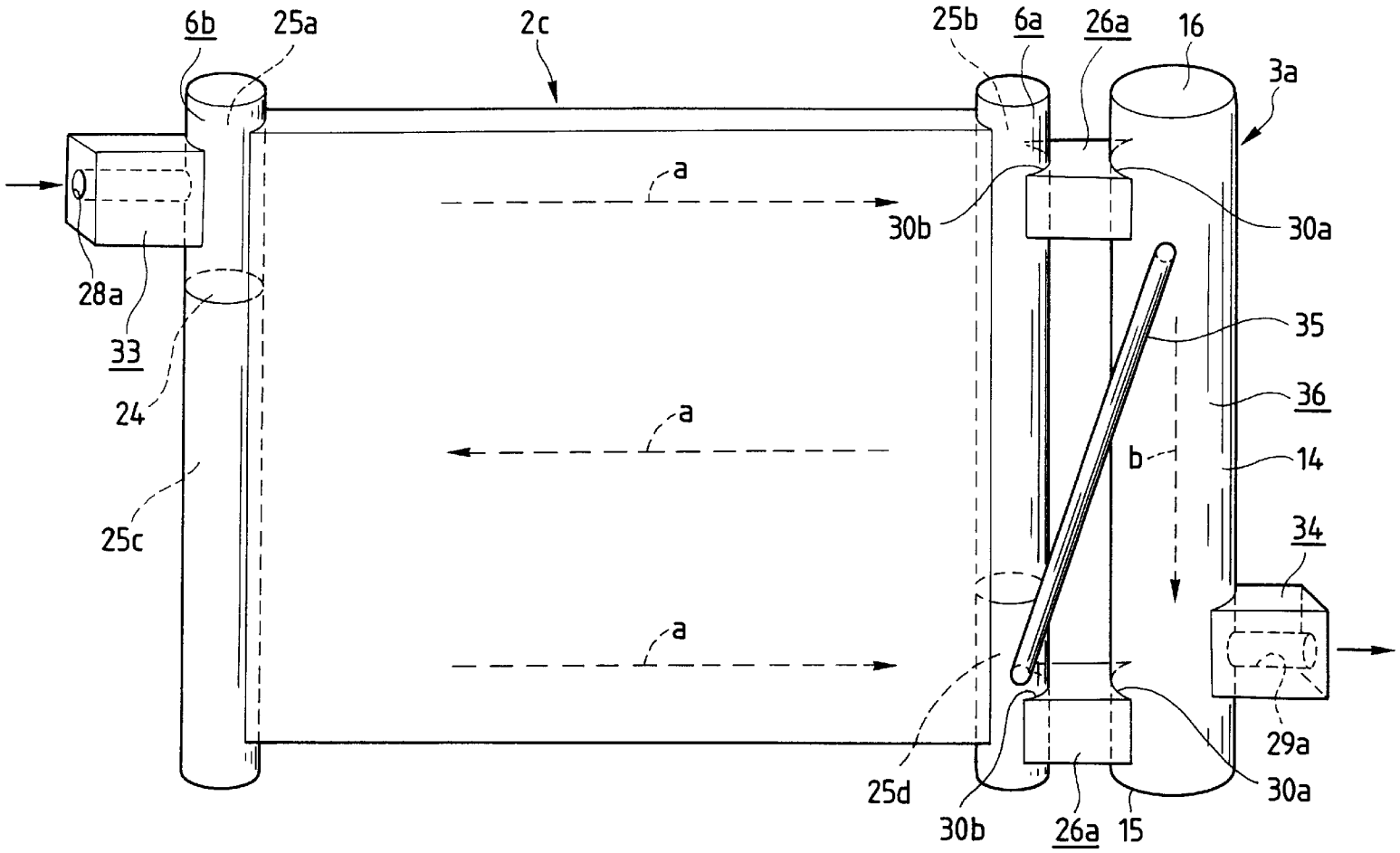
FIG. 6 is a perspective view outlining a third embodiment of the invention.

FIG. 6 shows a third embodiment of the invention. In the third embodiment, the technical concept of the invention is applied to a condenser with a liquid tank which has no sub-condenser. That is, the third embodiment is substantially obtained by removing the sub-condenser 23 (cf. FIG. 5) from the second embodiment. Furthermore, in the third embodiment, the lower coupling bracket 26*a* through which the header pipe 6*a* is welded to the liquid tank 3*a* by brazing has no coolant passageway pipe 32 (FIGS. 1 through 4) similarly as in the case of the upper coupling bracket 26*a* in the above-described second embodiment. The outlet block 34, through which liquid-phase coolant is discharged, is secured to the lower portion of the liquid tank 3*a*, and the inner end of the outlet hole 29*a* of the outlet block 34 is coupled to the inner wall of the lower end portion of the liquid tank 3*a* . In the above-described condenser with the liquid tank (the third embodiment), the coolant flows in the condenser 1c as indicated by the arrow a, so that it is condensed and liquified. The coolant thus liquified is supplied through the coolant pipe 35 into the upper portion of the liquid tank 3*a*, and then flows downwardly as indicated by the arrow b while foreign matter and moisture being removed therefrom. And the coolant thus treated is sent to the evaporator through the outlet hole 29*a* of the outlet block 34. The other arrangements of the third embodiment are equal to those of the first and second embodiments, and therefore in FIG. 6 parts corresponding functionally to those already described with reference to the first and second embodiments are therefore designated by the same reference numerals or characters.

The condenser with the liquid tank according to the invention is designed and functions as described above. Hence, the liquid tank and the condenser can be welded to each other with high efficiency by brazing, assembled with high work efficiency, and are improved in coupling force.

What is claimed is:

1. A condenser with a liquid tank comprising:

(1) a condenser including:

a pair of first and second header pipes which are arranged spaced from each other;

a plurality of heat-transmitting pipes in which both ends of each of said heat transmitting pipes are opened inside said first and second header pipes, respectively; and fins provided between said heat-transmitting pipes;

(2) a liquid tank including a casing which is arranged along said first header pipe; and (3) a coupling bracket which is smaller in thermal capacity than said casing and said first header pipe, one end of said coupling bracket being secured to an outer cylindrical surface of said casing by brazing, and the other end thereof being secured to an outer cylindrical surface of said first header pipe; and wherein a coolant passageway pipe is fixedly inserted into a hole provided in said coupling bracket.

2. The condenser with a liquid tank according to claim 1, further comprising two coupling brackets, wherein each coupling bracket is brazed at both end portions to said first header pipe and casing, respectively.

3. The condenser with a liquid tank according to claim 1, wherein at least one recess is formed in a surface of said coupling bracket to reduce a volume of said coupling bracket and increase a surface area thereof.

4. The condenser with a liquid tank according to claim 1, wherein a vertical through-hole is formed in said coupling bracket to reduce a volume of said coupling bracket and increase a surface area thereof.

5. The condenser with a liquid tank according to claim 1, wherein said first header pipe and said casing are made of an aluminum alloy.

* * * * *